US009114443B2

(12) United States Patent
Hallundbæk

(10) Patent No.: US 9,114,443 B2
(45) Date of Patent: Aug. 25, 2015

(54) PROPELLING TOOL

(75) Inventor: Jørgen Hallundbæk, Græsted (DK)

(73) Assignee: WELLTEC A/S, Allerod (DK)

( * ) Notice: Subject to any disclaimer, the term of this patent is extended or adjusted under 35 U.S.C. 154(b) by 889 days.

(21) Appl. No.: 13/386,190

(22) PCT Filed: Jul. 26, 2010

(86) PCT No.: PCT/EP2010/060776

§ 371 (c)(1),
(2), (4) Date: Jan. 20, 2012

(87) PCT Pub. No.: WO2011/012566

PCT Pub. Date: Feb. 3, 2011

(65) Prior Publication Data

US 2012/0132238 A1 May 31, 2012

(30) Foreign Application Priority Data

Jul. 27, 2009 (EP) ..... 09166428

(51) Int. Cl.
*B08B 9/049* (2006.01)
*B08B 9/051* (2006.01)

(52) U.S. Cl.
CPC ..... *B08B 9/0495* (2013.01); *B08B 9/049* (2013.01); *B08B 9/051* (2013.01); *Y10T 137/85978* (2015.04)

(58) Field of Classification Search
None
See application file for complete search history.

(56) References Cited

U.S. PATENT DOCUMENTS 4,756,324 A 7/1988 Larsson

FOREIGN PATENT DOCUMENTS

DE 199 15 413 11/1999
WO WO 85/05295 12/1985

OTHER PUBLICATIONS

International Search Report for PCT/EP2010/060776, mailed Oct. 18, 2010.
Written Opinion of the International Searching Authority for PCT/EP2010/060776, mailed Oct. 18, 2010.
Notification Concerning Transmittal of International Preliminary Report on Patentability and International Preliminary Report on Patentability for PCT/EP2010/060776, issued Jan. 31, 2012, 8 pages.

*Primary Examiner* — Jason Ko
(74) *Attorney, Agent, or Firm* — Nixon & Vanderhye P.C.

(57) ABSTRACT

The present invention relates to a propelling tool (1) enabling a forward drive for operation in a pipeline (3), a casing, a well, or any other cavity. The propelling tool comprises a supply tubing (4) containing the supply fluid, a housing (5) connected to the supply tubing having a supply inlet provided in the rear end of the housing for supplying pressurized supply fluid from the supply tubing, a supply outlet provided in the rear end of the housing for ejection of the supply fluid, a suction inlet provided in the front end for an intake of cavity fluid surrounding the tool into the housing, and a suction outlet provided in the rear end for an outlet of cavity fluid, and a pump (10) for suction of cavity fluid in through the suction inlet and out through the suction outlet. The pump is driven by the pressurized supply fluid for pulling the tool forward in a cavity.

11 Claims, 5 Drawing Sheets

PROPELLING TOOL

This application is the U.S. national phase of International Application No. PCT/EP2010/060776, filed 26 Jul. 2010, which designated the U.S. and claims priority to EP Application No. 09166428.4, filed 27 Jul. 2009, the entire contents of each of which are hereby incorporated by reference.

TECHNICAL FIELD

The present invention relates to a propelling tool for releasing precipitated solids, such as ice, scales, and the like in a cavity fluid in a pipeline, a casing, a well, or any other cavity.

BACKGROUND

Pipelines are used to transport oil, gas, and the like, e.g. from oil rigs to the shore. Such oil fluid contains constituents of water, and since the pipelines lie on the sea-bed covered by water, the ambient temperature may result in a cooling of the oil fluid to such an extent that the water constituents precipitate as ice on the inside wall of the pipeline. The precipitated ice may, at least partly, block the flow in the pipelines, thus decreasing the velocity of the oil fluid.

Furthermore, the water constituents in the oil may comprise alkaline earth cations and anions, and water-insoluble scales are formed when cations and anions are present in a certain concentration.

In order to remove such ice and scales, pipeline pigs are inserted into the pipeline to loosen and brush off the ice and scales. However, the insertion of such pipeline pigs in the oil fluid is a very complicated process and, in the event that the pipeline pigs get stuck due to a blockage in the pipeline, the pipeline pigs are not easily retracted from the pipeline again.

Thus, there is a need for a tool which can move forward in a blocked pipeline in order to retract the pipeline pigs again and/or clean the pipeline.

DESCRIPTION OF THE INVENTION

An aspect of the present invention is, at least partly, to overcome the above-mentioned disadvantages by providing a propelling tool which is as well easy to insert into the pipeline, easy to retract from the pipeline again, and able to move forward in a closed pipeline for removing the blocking elements, such as a pipeline pig, scales, or ice.

This aspect and the advantages becoming evident from the description below are obtained by a propelling tool which enables a forward drive for operation in a pipe-line (3), a casing, a well, or any other cavity, comprising:

- a supply tubing containing a pressurised supply fluid,
- a housing connected to the supply tubing, having:
  - a supply inlet provided in a rear end of the housing for supplying pressurised supply fluid from the supply tubing,
  - a supply outlet provided in a rear end of the housing for ejection of supply fluid,
  - a suction inlet provided in the front end for an intake of cavity fluid surrounding the tool into the housing, and
  - a suction outlet provided in the rear end for an outlet of cavity fluid, and
- a pump for suction of cavity fluid in through the suction inlet and out through the suction outlet, the pump being driven by the pressurised supply fluid for pulling the tool forward in a cavity.

By having a propelling tool according to the present invention, a very simple construction of a tool is provided which is able to move forward in a borehole or a casing downhole. The propelling tool is able to propel forward in fluid flowing in the casing even though the fluid is stagnant due to a blocked casing. Such propelling tool can be used for a variety of purposes such as for fetching a stuck pipeline pig downhole or for moving a releasing tool forward in the casing for releasing precipitated solids on the in side of the casing.

In one embodiment of the propelling tool, the housing may have a sealing means for abutment against the cavity, such as the pipeline, the casing, or the well.

In another embodiment, the propelling tool may have a turbine positioned between the supply inlet and the pump, the turbine being connected with the pump via a shaft and driven by the pressurised fluid for driving the pump.

The invention also relates a releasing system for releasing precipitated solids, such as ice, scales, and the like in a cavity fluid in a pipeline, a casing, a well, or any other cavity, comprising:

- a propelling tool according to one of the above-mentioned embodiments, and
- a releasing means for releasing the precipitated solids from the cavity.

In one embodiment of the releasing system, the releasing means may be the turbine of the propelling tool having at least one ejection outlet for a direct ejection of supply fluid into the cavity bypassing the pump in order to release the precipitated solids from the cavity.

In another embodiment of the releasing system, the releasing means may be at least one bypassing channel fluidly connected to the supply inlet for a direction of part of the supply fluid out through at least one ejection outlet directly ejecting the supply fluid into the cavity bypassing the pump in order to release the precipitated solids from the cavity.

In yet another embodiment of the releasing system, the releasing means may be a bypassing means in connection with the turbine enabling a bypassing of the turbine for ejecting the pressurised fluid directly into the cavity through the ejection outlet.

In addition, the supply fluid can be water mixed with any kind of alcohol or other kind of solvent before being ejected through the ejection outlet.

In one embodiment, the releasing means is a releasing tool provided on the shaft in front of the propelling tool when moving forward in the cavity.

According to the invention, the releasing tool may have at least one cutting edge.

Moreover, the releasing tool may have at least one scraper, knife, share, or bit.

In another embodiment, the releasing system may further comprise a driving unit, such as an electrical motor, for rotating the releasing means.

In addition, the releasing means may be a fastening device provided on the shaft for fastening to a pipeline pig and releasing the pipeline pig and bringing it to above surface.

Finally, the fastening device may have at least one retractable barb able to retract into a shaft and to expand when the fastening device needs to enter a through-going hole in the pipeline pig.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
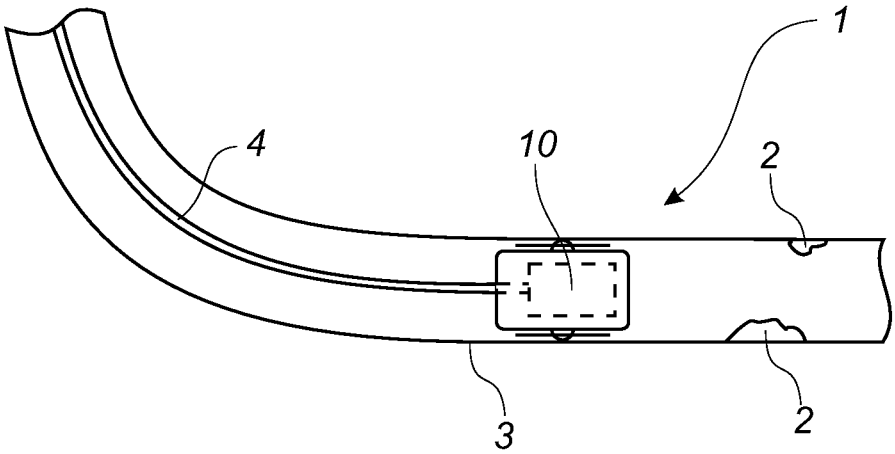
FIG. 1 shows a propelling tool according to the present invention in a pipeline.

FIG. 1 shows a propelling tool 1 according to the present invention inserted into a pipeline 3 for driving itself forward in the pipeline. The propelling tool 1 may be used for several purposes, e.g. fetching a pipeline pig 19 or releasing precipitated solids 2 in a pipeline. The tool 2 may also be used to clean other cavities than pipe-lines 3, such as a casing, a well, or any other suitable cavity. In the following, the invention will be explained with reference to a pipeline with oil fluid.

A pipeline 3 is used for transporting fluid, such as oil, a mix of oil with water, gas, etc., from an oil rig to the refineries on shore. In many drilling operations, the oil fluid is mixed with filtrate or other additives in order to improve the drilling process. Furthermore, the fluid may contain other elements such as cuttings, swarf, sand, pipe dope, remains from a previous explosion, rust from the casing in the well, or detachments torn off from the well, the casing, or the formation. In the following, the invention will be explained with reference to a pipeline 3 conveying oil fluid.

Oil fluid brought up from downhole often contains constituents of water, and when the constituents of water subsequently run through the pipeline 3, the ambient temperature may result in a cooling of the oil fluid to such an extent that the constituents of water precipitate as ice 2 on the inside wall of the pipeline 3. Furthermore, the water contains cations and anions which in certain concentrations also precipitate as scales 2 on the inside wall of the pipeline 3.

The precipitated solids 2 may block the pipeline 3 to such an extent that prior art pipeline pigs 19 are unable to move forward in the pipeline 3 and release the solids 2. One advantage of the propelling tool 1 of the present invention is that it is able to move forward in a blocked pipeline 3 in order to remove the blocking elements, such as scales or ice, using additional equipment.

Usually, the blocked pipeline 3 is only blocked to an extent where pipeline pigs 19 may still be inserted and move with the oil in the pipeline. However, if the pipeline pigs 19 are hindered from moving forward in the pipeline 3 due a large ice or scale obstruction, the oil fluid pressure will press the pipeline pigs up against the obstruction and the pipeline pigs will block the pipeline. In the following, such an obstruction and/or a stuck pipeline pig will be referred to as a blocking element. A further advantage of the propelling tool 1 is that it is able to move forward in blocked pipeline in order to remove blocking elements, such as a pipeline pig, before removing additional blocking elements, such as scales or ice.

The propelling tool 1 is driven forward in the pipeline 3 by sucking oil fluid into the tool 1 via inlets 8 in the front end of the tool 1 and ejecting the same fluid in the rear end the tool 1. In this way, a lower pressure is created in front of the tool 1 than behind the tool, whereby the tool moves forward in the pipeline 3.

Thus, the propelling tool 1 is very easy to use in a pipeline 3 in order to remove a pipeline pig 19 or to clean the pipeline 3. The propelling tool 1 can be used to release precipitated solids 2 on the inside of the pipeline wall, i.e. for the same purpose as a pipeline pig. However, contrary to prior art pipeline pigs 19, the propelling tool 1 needs no launching equipment.

In order to suck oil fluid into the tool 1 through a suction inlet 8, the tool 1 comprises a pump 10 situated in a housing 5 of the tool 1. The housing 5 is connected to a supply tubing 4 containing a highly pressurised supply fluid. The pump 10 is driven by the pressurised fluid, and the energy of the highly pressurised fluid in the supply tubing 4 is thus used to drive the pump 5. The pump 5 sucks the oil fluid into the front end of the tool 1 and out again in the rear end of the tool 1. The fluid sucked in through the suction inlet 8 enters the pipeline 3 again through a suction outlet 9.

The supply tubing 4 is connected to a supply inlet 6 in the housing 5 in the rear end of the tool 1 for supplying highly pressurised fluid to the tool 1. The supply fluid enters into the pipeline again through a supply outlet 7. The supply tubing 4 follows the propelling tool 1 all the way through the pipeline 3 and can at every moment be used to retract the propelling tool 1 from the pipeline 3.

Figure 5:
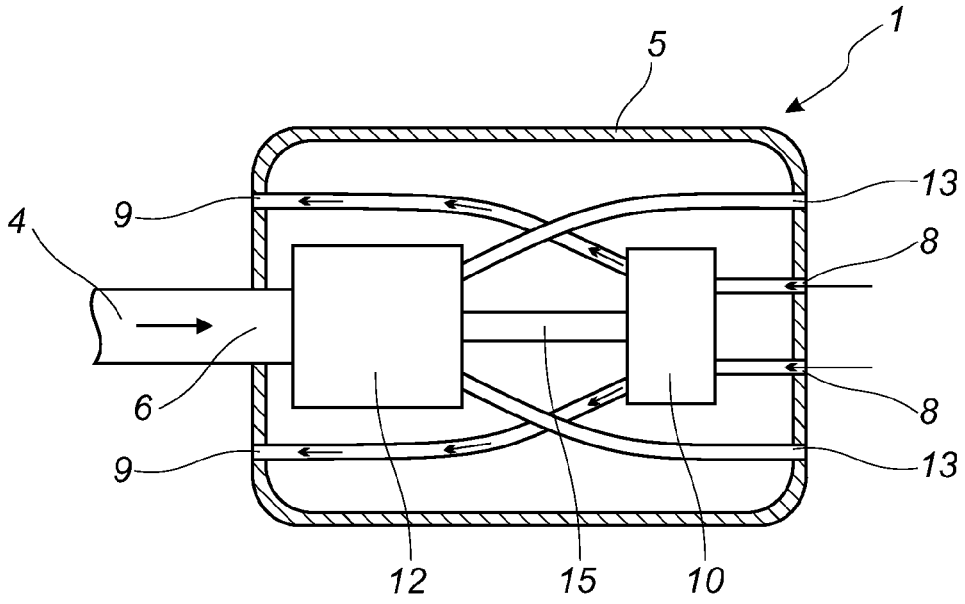
FIGS. 5 and 6 show partially cross-sectional views of another embodiment of the releasing system.
Figure 6:
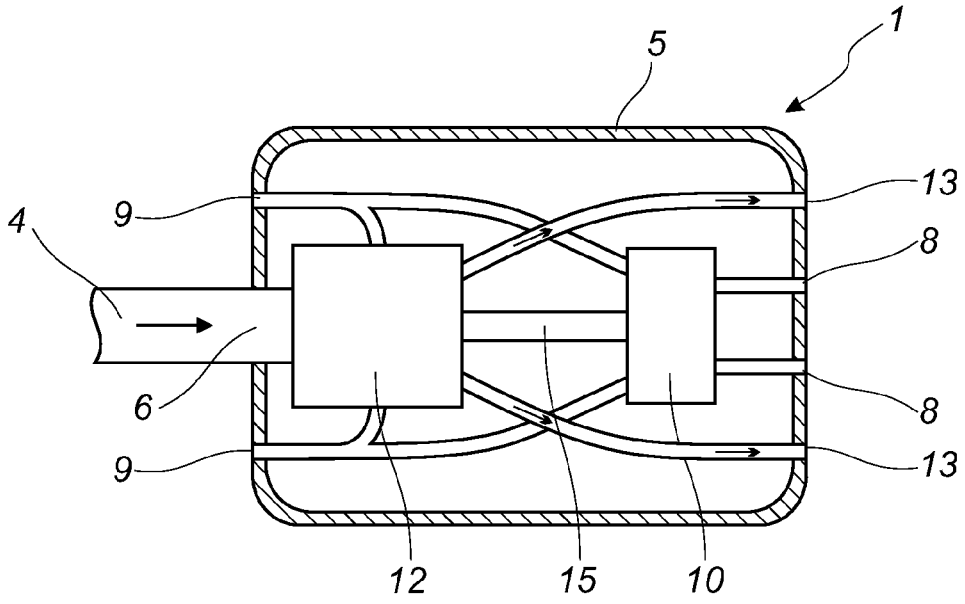

In one embodiment of the propelling tool, the supply outlet 7 and the suction outlet 9 is one and the same outlet as shown in FIGS. 5 and 6.

In prior art solutions, the pipeline pigs 19 are launched in the oil fluid for cleaning the pipeline 3. In order to remove a stuck pipeline pig 19, the oil fluid needs to be sucked in the reverse direction using additional equipment.

The propelling tool 1 of the present invention requires no additional equipment in order to be retracted/retract a pipeline pig 19 again in the event that the cleaning operation fails, e.g. due to a large obstruction in the pipeline 3. Furthermore, the propelling tool 1 needs not to enter the whole pipeline 3 as the known solutions of prior art, or be sucked all the way back again using an additional suction apparatus, thus saving both time and money for additional equipment.

In order to conform to any kind of pipeline 3, the supply tubing 4 is flexible. The supply fluid is typically seawater, which in some events is mixed with a kind of solvent able to dissolve e.g. ice or scales. A solvent may be any kind of alcohol or the like solvent.

Figure 2:
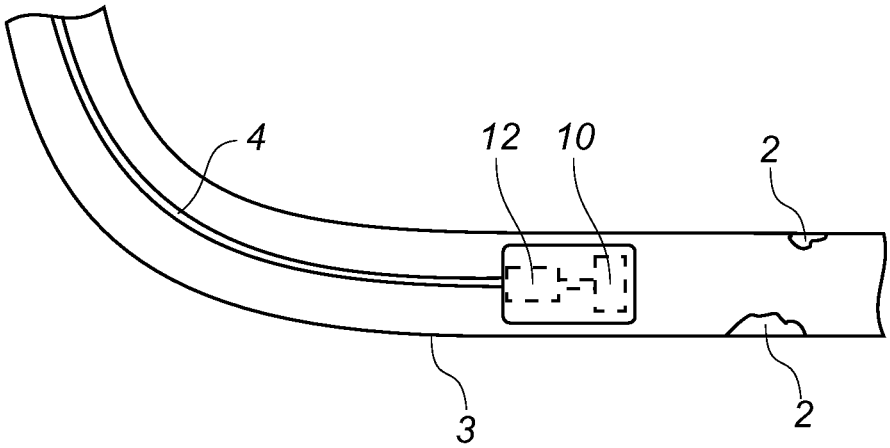
FIG. 2 shows another embodiment of a propelling tool according to the present invention.

In another embodiment, as shown in FIG. 2, the propelling tool 1 comprises a turbine 12 situated in the housing 5 between the supply inlet 6 and the pump 5, the supply fluid thus driving the turbine 12 and, through the turbine 12, the pump 5. Thus, the turbine 12 is connected with the pump 5 by means of a shaft 15 for driving the pump 5. The supply fluid enters the turbine 12 through the supply inlet 6 in the housing 5 and, subsequently, the fluid is ejected through the supply outlet 7.

Using a turbine 12 for driving the pump 10 makes it possible to use any kind of pump, such as a centrifugal pump or a piston pump, and the tool will moreover have higher overall efficiency than a tool without a turbine. However, a suitable pump 10 in a propelling tool 1 without a turbine 12 could be an injector pump, an ejector pump, a jet pump, or a venturi pump.

Figure 3:
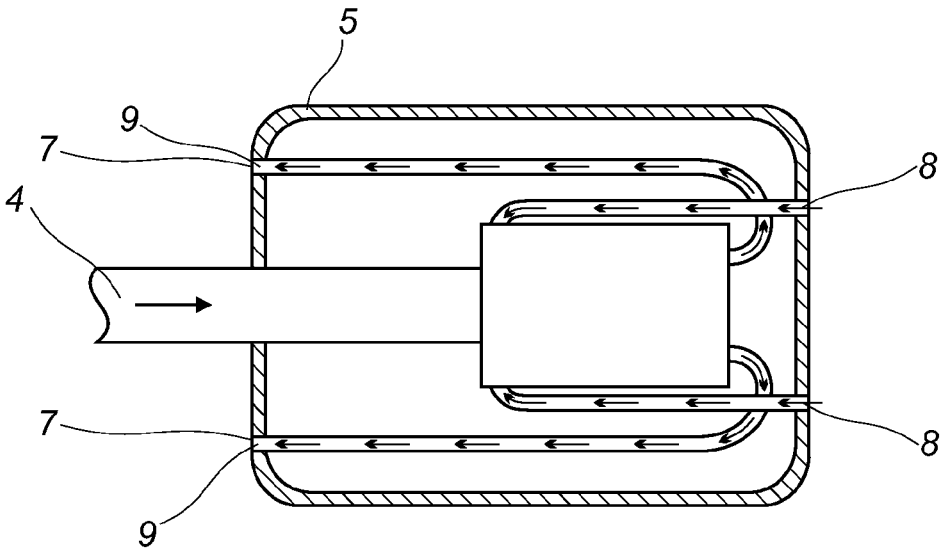
FIG. 3 shows a partially cross-sectional view of the propelling tool of FIG. 1.

A propelling tool 1 without a turbine is shown in FIG. 3. The supply fluid is supplied to an ejector pump for driving the pump to suck cavity fluid in through the suction inlet 8. The cavity fluid and the supply fluid are subsequently let out through one and the same outlet functioning both as a supply outlet 7 and a suction outlet 9.

The propelling tool 1 may be used together with a releasing means for releasing an element from the pipeline 3 or another cavity, which releasing means together with the propelling tool constitutes a releasing system 20. The releasing means may be a turbine 12 ejecting supply fluid directly into the cavity, a releasing tool 14, or a bypassing channel 17.

Figure 4:
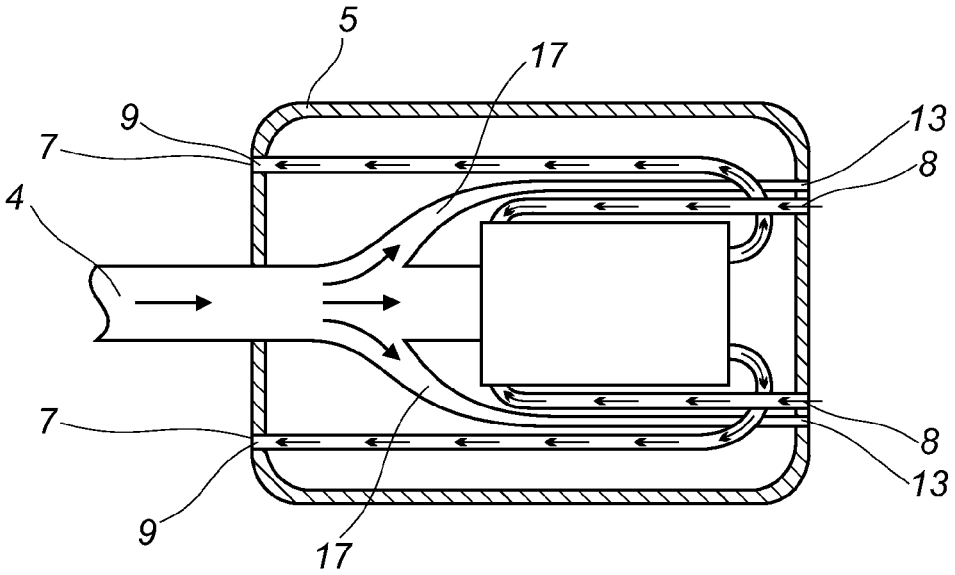
FIG. 4 shows a partially cross-sectional view of a releasing system according to the present invention.

One embodiment of a releasing system 20 without a turbine is shown in FIG. 4. In this embodiment, the supply fluid is partly let into the pump 10 and partly ejected through at least one ejection outlet 13 for a direct ejection of supply fluid into the cavity bypassing the pump 5 in order to release the precipitated solids 2 from the inside wall of the pipeline 3. The supply fluid let into the pump drives the pump. The pressure on the ejected supply fluid is controlled by the size of the diameter of the ejection outlet 13.

Another embodiment of the present invention comprising a turbine is shown in FIG. 5, in which the turbine 12 ejects the supply fluid into the cavity bypassing the pump 5 in order to release the precipitated solids 2 with the highly pressurised supply fluid. When the supply fluid bypasses the pump 5, the pump 5 stops and is no longer driven by the turbine 12 since the supply fluid is ejected directly out into the pipeline 3.

Figure 7:
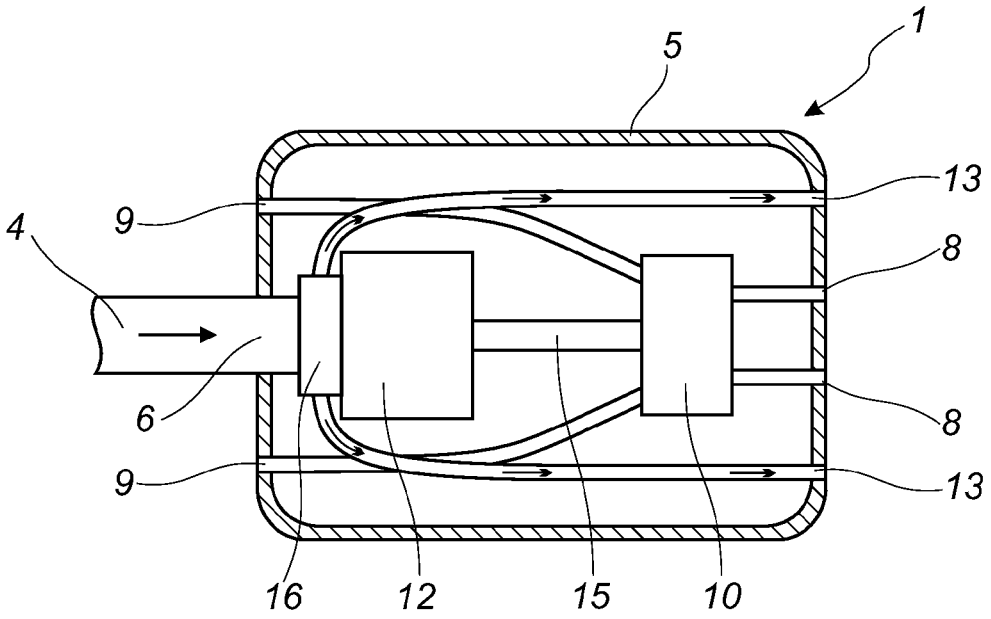
FIG. 7 shows a partially cross-sectional view of yet another embodiment of the releasing system.

In yet another embodiment, shown in FIG. 7, the turbine 12 has a bypassing means 16 so that the supply fluid is directed to bypass the turbine blades of the turbine 12 and transmit as much of the energy from the pressurised supply fluid as possible into the pipeline 3. The bypassing means 16 may be any kind of direction means or control means, such as a valve. The supply fluid may also be let past the turbine in the same manner as shown in FIG. 4 through bypassing channels 17.

In FIG. 5, the releasing system 20 is shown when the turbine 12 drives the pump 5 for sucking cavity fluid into the tool 1 in order to move the tool 1 forward to release precipitated solids 2. When the releasing system has arrived at a position in the pipeline 3 where the precipitated solids 2 are so big that they block the way of the releasing system, the releasing system stops and the pressurised supply fluid is directed to bypass the pump 5 and is ejected directly from the supply tubing 4 into the cavity. Thus, all the energy of the pressurised supply fluid is used to release the solids 2 as shown in FIG. 6.

In some events, the pressurised supply fluid is mixed with some kind of solvent. When the solids 2 have been released and/or dissolved, the releasing system continues to move forward in the pipeline 3.

Figure 8:
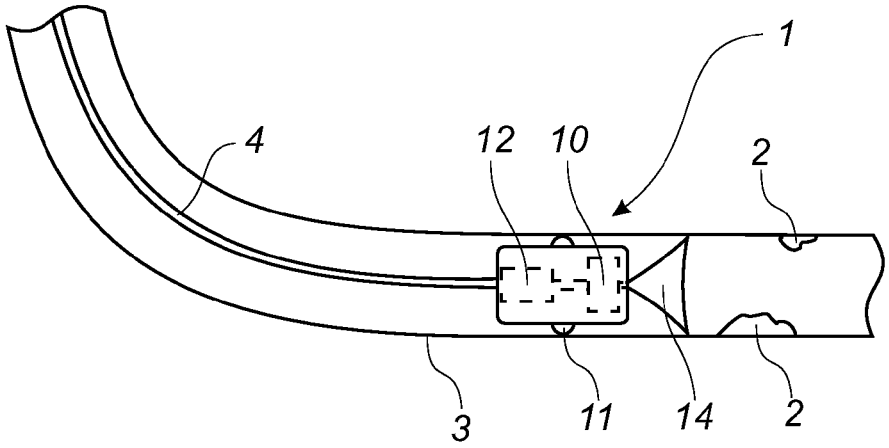
FIG. 8 shows yet another embodiment of the releasing system in a pipeline.
Figure 9:
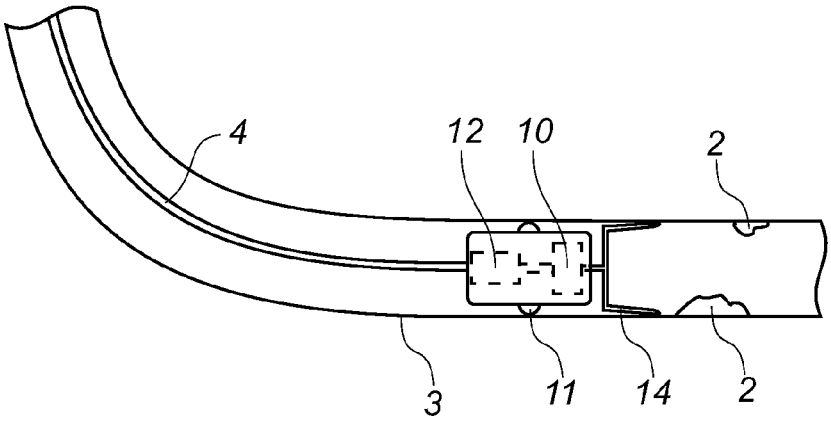
FIG. 9 shows an additional embodiment of the releasing system in a pipeline.

In some embodiments, shown in FIGS. 8 and 9, the releasing system 20 further comprises a releasing tool 14 situated in front of the tool 1. In one embodiment, the releasing tool 14 has a cutting edge, such as a blade, a knife, or the like cutting tool. In another embodiment, the releasing tool 14 has a scraper. The scraper may have a plurality of arms, such as a slit cylinder, or just two arms like a fork. The scraper may also have some kind of projection extending radially out towards the side wall of the pipeline 3.

The releasing tool 14 is situated in the front end of the tool 1 when moving forwarding the pipeline 3. The releasing tool 14 is connected to the shaft 15 between the turbine and the pump. Thus, the releasing tool 14 rotates with the pump 5 in order to release the precipitated solids 2.

As shown in FIGS. 8 and 9, the releasing system 20 may have a sealing means 11 or flexible means 11 provided on the outside of the housing 5 for abutment against the inside wall of the pipeline 3. The sealing means or flexible means 11 is made of a flexible material, such as polymer, silicone, etc. In one embodiment, the sealing means 11 is an O-ring, and in another the flexible means 11 is an inflatable means that is inflated, e.g. by the supply fluid. Thus, the flexible means 11 is inflated so as to diminish the passage of oil fluid along the outside of the tool, but not necessarily to abut the inside wall of the pipeline 3. By having such a flexible means 11 diminishing the passage along the tool 1, the tool is able to move even in a pipeline having a varying inside diameter.

Figure 10:
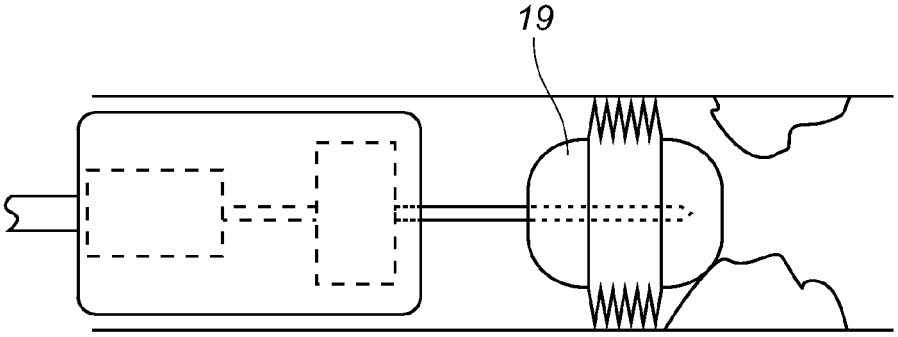
FIGS. 10 and 11 show additional uses of the propelling tool of FIG. 2.
Figure 11:
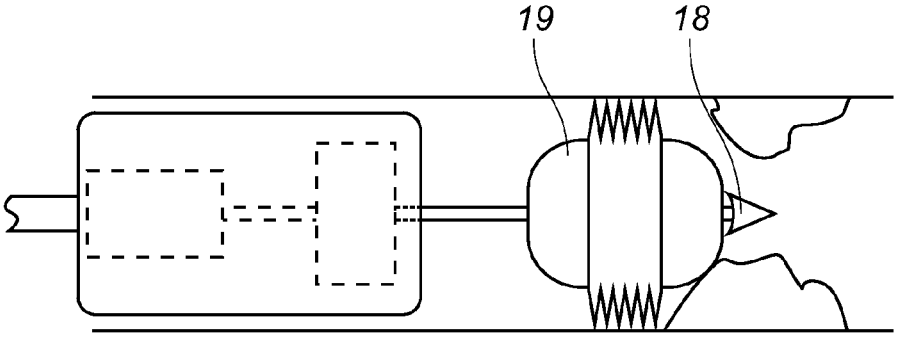

The releasing system 20 of the present invention may also be used when a pipeline 3 has been blocked by a pipeline pig 19 being unable to pass precipitated solids 2 on the inside wall of the pipeline. Thus, the releasing system 20 may be provided with a drill bit situated on the shaft 15 of the tool for drilling its way through the pipeline pig as shown in FIG. 10. Subsequently, the releasing system 20 is retracted from the pipeline and the drill bit is replaced with a fastening device 18 having a barb or a set of barbs which initially is in its collapsed or retracted position. The releasing system 20 is then submerged into the pipeline and moves forward in the same manner as mentioned above. When meeting the stuck pipeline pig 19, the fastening device 18 with the retracted barb is placed in the hole drilled during the previous step. When the barb exits on the other side of the pipeline pig as shown in FIG. 11, the barb is unfolded or expanded. In this way, the releasing system 20 is able to retract the pipeline pig 19 when the system itself is retracted.

The barb or set of barbs may have any kind of shape and be any kind of collapsible device being able to unfold when the fastening device 18 has penetrated the through-going hole of the pipeline pig, or a device being retractable into the shaft. In one embodiment, the barb or set of barbs is unfolded just like an umbrella. In another embodiment, the barb is constituted by two arms which are released and unfold when no longer pressed towards the shaft entering the through hole of the pig. In this case, the arms are made of a bendable material, such as metal or plastic, which is able to return to it's originally shape when the stress is removed.

When the pipeline pig 19 has been retracted from the pipeline 3, the cleaning operation is resumed by submerging a releasing system of the present invention able to release precipitated solids 2 from the inside wall of the pipeline.

The turbine 12 may be any kind of turbine able to convert energy from a flow of highly pressurised fluid into rotation of a pump.

Precipitated solids 2 may be formed from any kind of fluid able to solidify within a pipeline or a like cavity. Typically, such solids 2 are solidified impurities in the oil or gas, such as ice or scales. Scales are formed due to the fact that the water constituents in the oil may comprise alkaline earth cations and anions, and water-insoluble scales are formed when cations and anions are present in a certain concentration.

The invention claimed is:

1. A propelling tool for enabling a forward drive for operation in a pipeline, a casing, a well, or any other cavity, comprising:

a supply tubing comprising a pressurised supply fluid, a housing connected to the supply tubing, having:

a supply inlet provided in a rear end of the housing for supplying pressurised supply fluid from the supply tubing, a supply outlet provided in the rear end of the housing for ejection of the supply fluid, a suction inlet provided in a front end of the housing for an intake of cavity fluid surrounding the tool into the housing, and a suction outlet provided in the rear end of the housing for an outlet of cavity fluid, and a pump for suction of cavity fluid in through the suction inlet and out through the suction outlet, the pump being driven by the pressurised supply fluid for pulling the tool forward in a cavity.

2. A propelling tool according to claim 1, wherein the housing has a seal to abut against the cavity.

3. A propelling tool according to claim 1, wherein a turbine is positioned between the supply inlet and the pump, is connected with the pump via a shaft, and is driven by the pressurised fluid for driving the pump.

4. A releasing system for releasing precipitated solids, in a cavity fluid in a pipeline, a casing, a well, or any other cavity, comprising:

a propelling tool according to claim 1, and a release device to release the precipitated solids from the cavity.

5. A releasing system according to claim 4, wherein the release device is a turbine of the propelling tool having at least one ejection outlet for a direct ejection of supply fluid into the cavity bypassing the pump in order to release the precipitated solids from the cavity.

6. A releasing system according to claim 4, wherein the release device is at least one bypassing channel fluidly connected to the supply inlet for a direction of part of the supply fluid out through at least one ejection outlet directly ejecting the supply fluid into the cavity bypassing the pump in order to release the precipitated solids from the cavity.

7. A releasing system according to claim 4, wherein the release device is a bypass device in connection with a turbine enabling a bypassing of the turbine for ejecting the pressurised fluid directly into the cavity through the ejection outlet.

8. A releasing system according to claim 4, wherein the supply fluid is water mixed with any kind of alcohol or other kind of solvent before being ejected through the ejection outlet.

9. A releasing system according to claim 4, wherein the release device is a releasing tool provided on the shaft in front of the propelling tool when moving forward in the cavity, and wherein the releasing tool has at least one cutting edge, scraper, knife, share, or drill bit.

10. A releasing system according to claim 4, wherein the release device is a fastener provided on the shaft for fastening to a pipeline pig and releasing the pipeline pig and bringing it to above surface.

11. A releasing system according to claim 10, wherein the fastener has at least one retractable barb able to retract into the shaft and to expand when the fastening device needs to enter a through-going hole in the pipeline pig.

* * * * *